US005816220A

United States Patent [19]

Stumpp et al.

[11] Patent Number: 5,816,220

[45] Date of Patent: Oct. 6, 1998

[54] PROCESS AND DEVICE FOR MONITORING A FUEL DELIVERY SYSTEM

[75] Inventors: Gerhard Stumpp; Johannes Locher, both of Stuttgart; Claus Maier, Ludwigsburg; Jürgen Biester, Böblingen; Werner Teschner, Stuttgart; Wilhelm Eyberg, Leonberg; Jochen Neumeister, Stuttgart, all of Germany

[73] Assignee: Robert Bosch GmbH, Stuttgart, Germany

[21] Appl. No.: 836,027

[22] PCT Filed: Apr. 24, 1996

[86] PCT No.: PCT/DE96/00749

§ 371 Date: Apr. 30, 1997

§ 102(e) Date: Apr. 30, 1997

[87] PCT Pub. No.: WO97/12131

PCT Pub. Date: Apr. 3, 1997

[30] Foreign Application Priority Data

Sep. 28, 1995 [DE] Germany ..... 195 36 109.1

[51] Int. Cl.[6] ..... F02D 41/22; F02D 41/38

[52] U.S. Cl. ..... 123/435; 73/119 A; 123/198 DB; 123/481; 123/456

[58] Field of Search ..... 123/198 D, 198 DB, 123/425, 435, 456, 479, 481; 73/119 A

[56] References Cited

U.S. PATENT DOCUMENTS

| | | | |
|---|---|---|---|
| 3,916,622 | 11/1975 | Gospodar | 123/198 DB X |
| 4,024,850 | 5/1977 | Peter et al. | 123/198 DB X |
| 4,499,876 | 2/1985 | Yamamoto | 123/479 X |
| 4,512,307 | 4/1985 | Igashira et al. | 123/198 D X |
| 5,201,294 | 4/1993 | Osuka | 123/198 D X |
| 5,241,933 | 9/1993 | Morikawa et al. | 123/198 D |
| 5,433,182 | 7/1995 | Augustin et al. | 123/198 DB X |
| 5,441,026 | 8/1995 | Akimoto | 123/198 D |

*Primary Examiner*—Tony M. Argenbright
*Attorney, Agent, or Firm*—Kenyon & Kenyon

[57] ABSTRACT

In a process and in a device for monitoring a fuel delivery system, in particular a common rail system for a diesel engine, a defect in the delivery system is found when a signal from a temperature sensor and/or a pressure sensor deviates from a predetermined value.

13 Claims, 4 Drawing Sheets

PROCESS AND DEVICE FOR MONITORING A FUEL DELIVERY SYSTEM

FIELD OF THE INVENTION

The present invention relates to a process and a device for monitoring a fuel delivery system.

BACKGROUND INFORMATION

A conventional process and a device for monitoring a fuel delivery system are described in U.S. Pat. No. 5,241,933, which describes a process and a device for monitoring the high-pressure circuit in a common rail system. The pressure in the rail is regulated with such device. If the manipulated variable of the pressure regulating circuit is outside a preset range, the device detects that there is an error.

In addition, there are conventional devices where the existence of an error is deduced on the basis of the pressure in the rail. To do so, the pressure is compared with upper and lower limits and an error is found if the pressure is outside the predetermined range.

A disadvantage of these arrangements is that the error is not detected until there is a great drop in pressure.

SUMMARY OF THE INVENTION

The object of the present invention is to make it possible to detect errors as easily and reliably as possible with a device and a process for monitoring a fuel delivery system.

Errors in the delivery system can be detected easily and reliably with the process and method according to the present invention. In particular, defective injectors in common rail systems can be detected reliably.

In addition, German Patent Application No. 44 40 700 describes a process wherein an electromagnetic high-pressure regulator on the downstream side of the high-pressure line is opened completely when an accident is detected by an airbag sensor. This leads to a pressure drop in the high-pressure part of the fuel delivery device.

DETAILED DESCRIPTION OF THE INVENTION

The device according to the present invention is described below using an example of a self-ignition internal combustion engine where fuel delivery is controlled by a solenoid valve. The embodiment illustrated in FIG. 1 relates to a common rail system, but the process according to the present invention is not limited to such systems. The process according to the present invention can be used with all systems where fuel is delivered in a similar manner.

An internal combustion engine 100 receives fresh air through an intake line 105 and gives off exhaust gases through an exhaust line 110.

Figure 1:
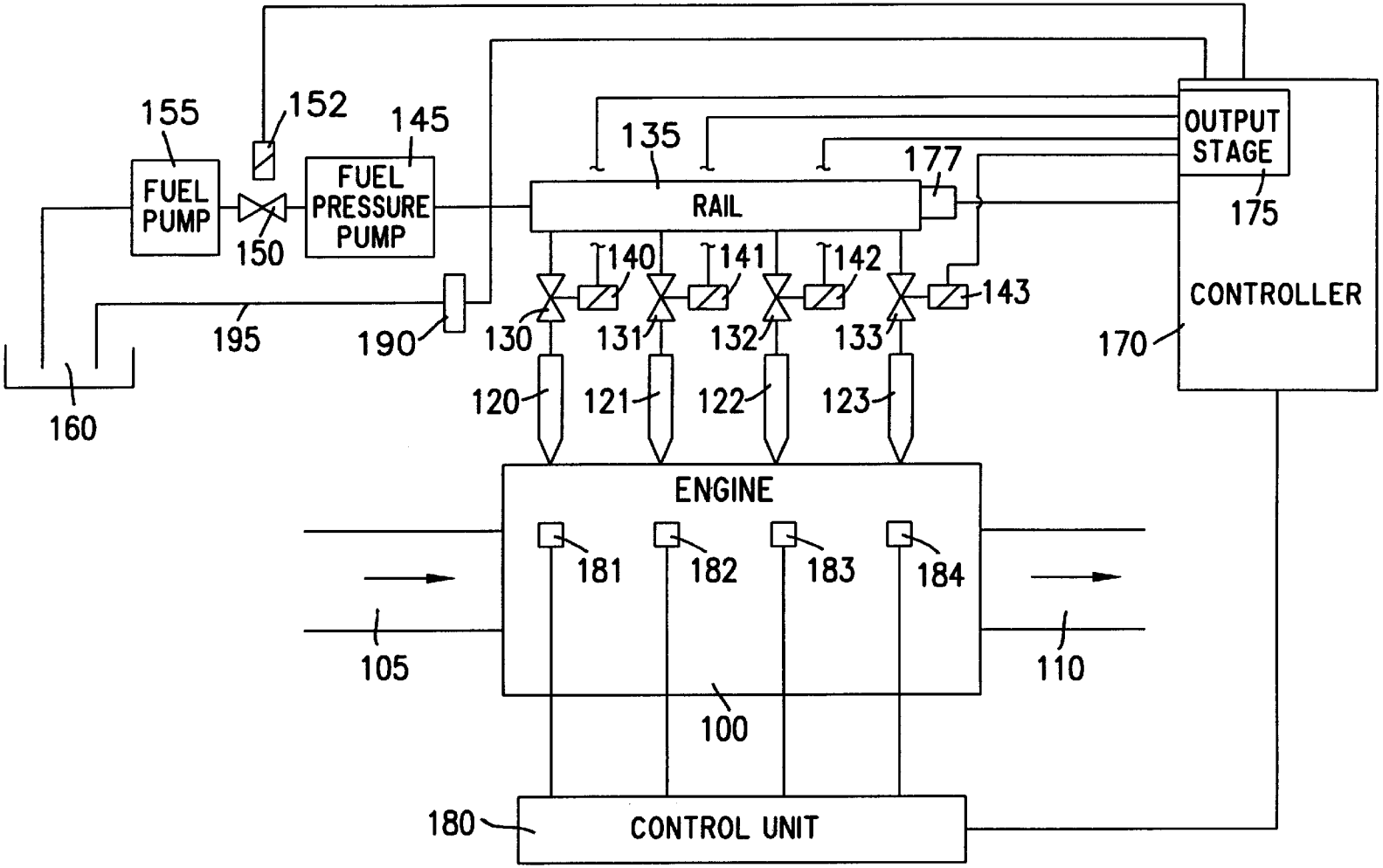
FIG. 1 shows a block diagram of the device according to the present invention.

The internal combustion engine 100 illustrated FIG. 1 is a four-cylinder combustion engine. One injector 120, 121, 122 and 123 is provided for each cylinder of the engine. Fuel is delivered to the injectors through solenoid valves 130, 131, 132 and 133. Fuel goes from rail 135 into the cylinders of combustion engine 100 through injectors 120, 121, 122 and 123.

The fuel in rail 135 is brought to an adjustable pressure by high-pressure pump 145. High-pressure pump 145 is connected to fuel pump 155 by solenoid valve 150. The fuel pump is connected to a fuel storage tank 160.

Valve 150 includes a coil 152. Solenoid valves 130, 131, 132 and 133 contain coils 140, 141, 142 and 143, each of which receives current by means of output stage 175. Output stage 175 is preferably arranged in a controller 170 that also drives coil 152.

In addition, a sensor 177 is also provided to detect the pressure in rail 135 and deliver a suitable signal to controller 170.

Sensors 181 through 184 sense the temperature in the combustion chambers of the individual cylinders. These sensors are connected to a control unit 180 that sends a signal to controller 170. The control unit 180 may be designed as a standalone controller, but it may also be integrated into controller 170.

A pressure regulating valve or pressure limiting valve 190 is arranged between high-pressure pump 145, rail 135 and a return line 195. Fuel goes through return line 195 back to storage tank 160. The pressure regulating valve can be triggered by controller 170, and when there is a suitable trigger pulse, it establishes the communication between rail 135 and return line 195 and thus also storage tank 160.

In another embodiment of the present invention, sensors 181 through 184 are designed as pressure sensors. These sensors detect the combustion chamber pressure in the combustion chambers of the individual cylinders.

The resultant device operates as follows. Fuel pump 155 delivers fuel from the storage tank 160 to high-pressure pump 145 through valve 150. High-pressure pump 145 establishes a predetermined pressure in rail 135. Pressures greater than 800 bar are usually achieved in rail 135.

Solenoid valves 130 through 133 are activated by energizing coils 140 through 143. Control pulses for the coils establish the beginning and end of fuel injection through injectors 120 through 123. The control pulses are established by the controller 175 depending on different operating conditions, such as the driver's intention, engine speed and other parameters.

With a common rail system, continuous injection by an injector cannot be detected reliably when there is a proper mass balance in the rail. This can occur, for example, when the solenoid valve receives current continuously or the injector is stuck or there is a leak. This can lead to an unwanted increase in pressure in a cylinder that can even destroy the engine if the peak cylinder pressure or allowable temperature is exceeded.

The temperature in the combustion chamber of each engine cylinder is measured by sensors 181 through 184. If the temperature of one of the cylinders exceeds a predetermined threshold, the fuel supply is reduced or stopped or other emergency measures are initiated.

In diesel engines, the sensor is integrated into the glow plug. This has the advantage that no additional bore in the engine is required. It is especially advantageous if the electric resistance of the glow plugs is used as a temperature signal. This resistance changes by a factor of about 2 to 4 in the temperature range from 0° to 1100° C. As an alternative, the thermal effect of the glow plugs can also be analyzed to provide a temperature signal.

To detect errors, the setpoint temperature in the combustion chamber is saved as a function of the setpoint amount of fuel and engine speed N. This setpoint temperature is compared with the temperature measured in the combustion chamber. If the actual temperature in the combustion chamber exceeds the setpoint by more than a temperature difference Δ for a period of time longer than ts, an error is deduced and fuel flow is greatly reduced or stopped.

If the above-mentioned temperature table is stored in the memory, the amount of fuel can be controlled before engine damage occurs, or fuel flow can be reduced before the vehicle is accelerated unintentionally. In one embodiment of the present invention, it is sufficient to store the setpoint temperature as a function of engine speed if preventing engine damage is the only requirement.

Figure 2:
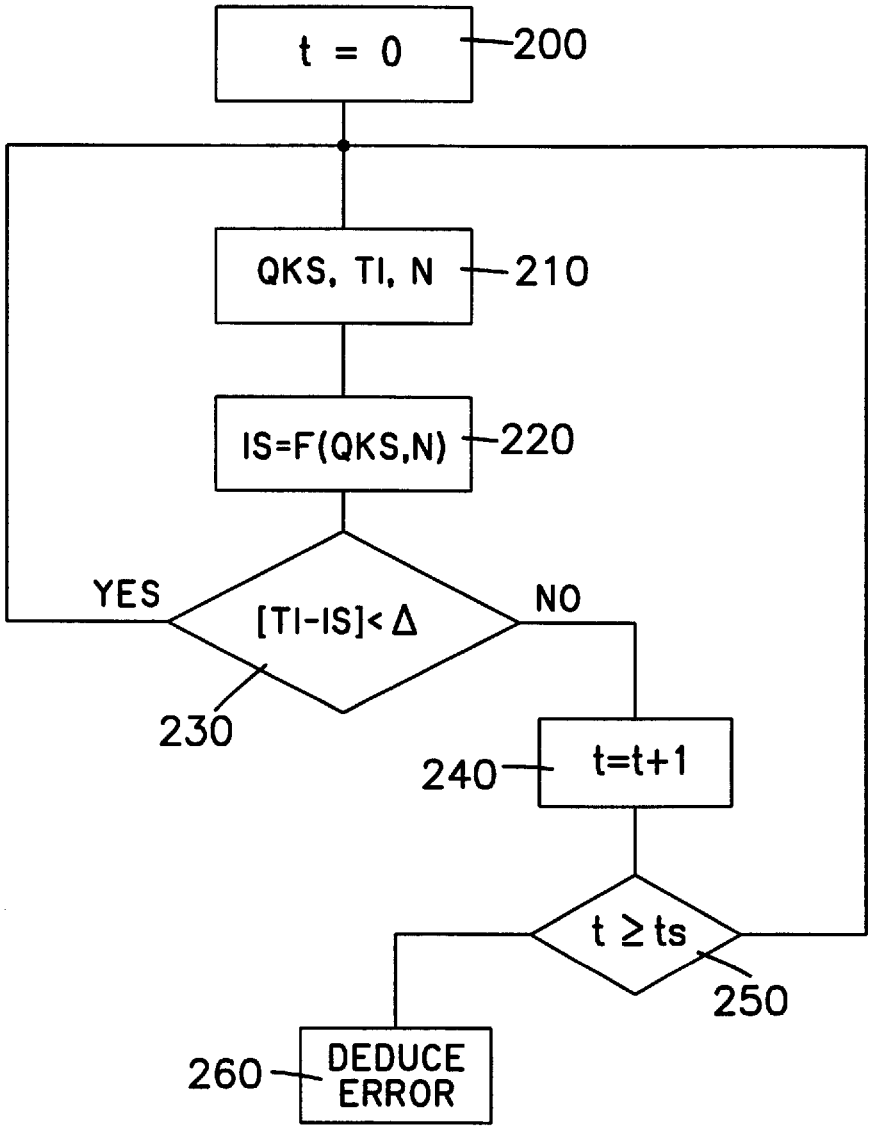
FIG. 2 shows a flow chart of a first embodiment of the process according to the present invention.

FIG. 2 shows a first embodiment of the process according to the present invention as a flow chart. In step 200 a counter t is set at zero. Then in step 210 the prevailing combustion chamber temperature TI, the amount of fuel QKS and engine speed N are detected. Any fuel quantity signal available in controller 170 such as the setpoint or actual fuel amounts can be used as fuel quantity QKS.

In step 220 the setpoint temperature IS is obtained from a table as a function F of fuel quantity QKS and engine speed N.

Query 230 determines whether the amount of the difference between the actual temperature TI and the setpoint temperature Ts is less than the temperature difference Δ. If this is the case, step 210 is repeated. If this is not the case, i.e., the actual temperature differs significantly from the setpoint temperature, timer t is incremented by one in step 240. Query 250 determines whether timer t is greater than or equal to threshold ts. If this is not the case, step 210 is performed again. If this is the case, an error is deduced in step 260 and appropriate measures are taken.

If the temperature of a cylinder differs from the expected value, an error in the corresponding injector or the corresponding solenoid valve is deduced.

Figure 3:
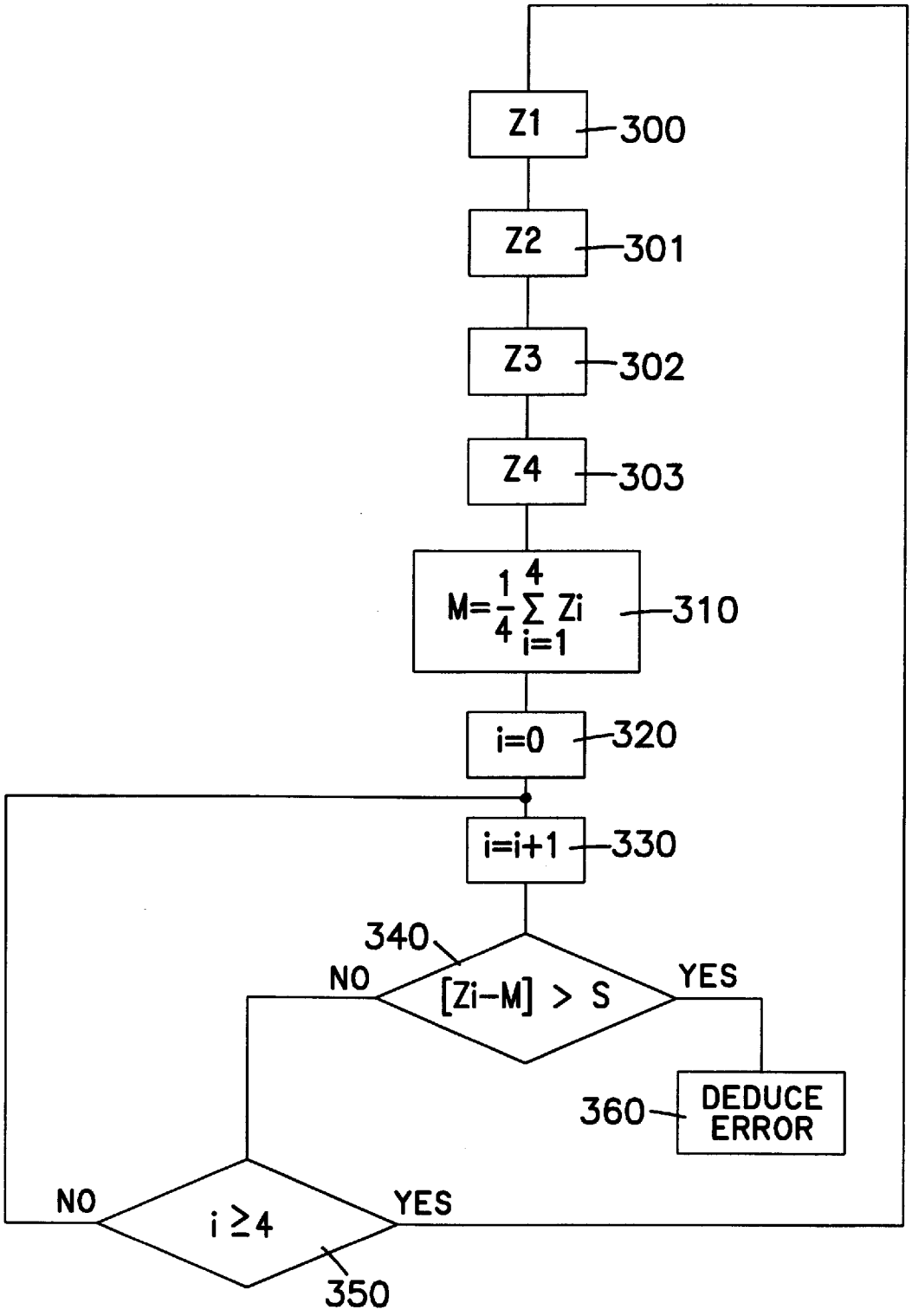
FIG. 3 shows a flow chart of a second embodiment of the process according to the present invention.

As an alternative, it is also possible for the deviation in temperature of a cylinder from the average over several cylinders to be evaluated. Such process is illustrated in FIG. 3 for a second embodiment of the present invention.

In step 300, the temperature signal of the first cylinder Z1 is detected. Similarly, the temperature signal of the second cylinder Z2 is detected in step 301. In steps 302 and 303 the temperature signal of cylinders Z3 and Z4 is detected. In step 310 the amplitudes of the four signals are added up and divided by 4. This yields the average M of the four temperature signals.

In step 320 a counter i is set at 0 and in the next step 330 it is incremented by 1. Query 340 determines whether the difference between the values Zi of the i-th cylinder and the average M is greater than threshold S. If this is not the case, query 350 determines whether i is greater than or equal to 4. If this is not the case, step 330 is performed again, or if i is greater than or equal to 4, step 300 is repeated.

If query 340 finds that the amount of the difference between the values of the i-th cylinder Zi and the average M is greater than threshold S, an error is deduced in step 360 and appropriate measures are initiated.

The second embodiment of the process according to the present invention has been described using the example for a four-cylinder internal combustion engine. This process can also be applied to combustion engines with a different number of cylinders through an appropriate choice of parameters, in particular i.

Figure 4:
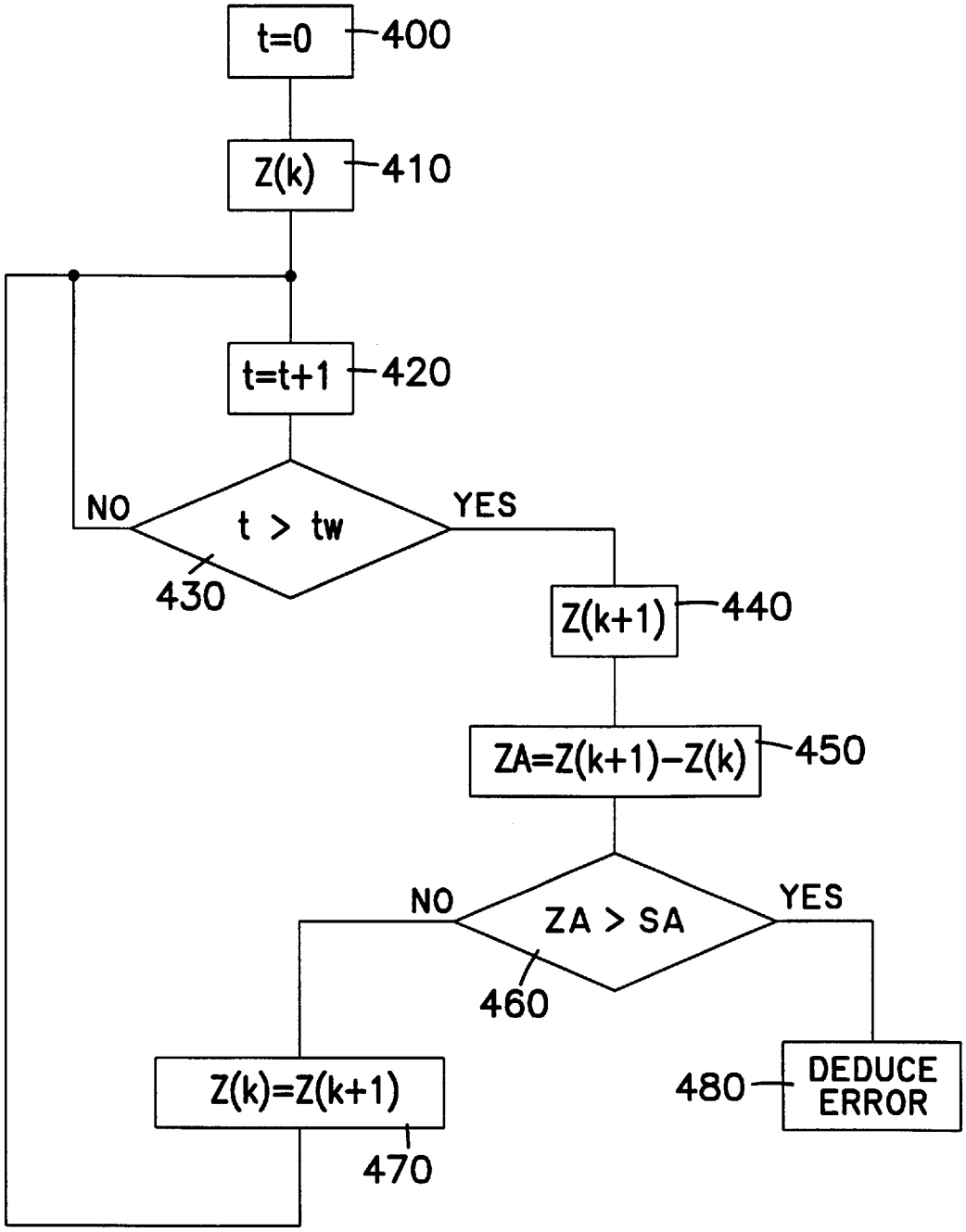
FIG. 4 shows a flow chart of a third embodiment of the process according to the present invention.

As an alternative, it is also possible to provide for a check on whether the temperature increases by more than a tolerance value within a predefined period of time, shown in FIG. 4 for the third embodiment according to the present invention in the form of a flow chart.

In a first step 400 a counter t is set at zero. In the next step 410, one of the temperature sensors 181 through 184 senses a temperature value Z(k) of the combustion chamber temperature. Then the time counter is increased by one increment in step 420. The subsequent query 430 determines whether a waiting time tw has elapsed. If this is not the case, step 420 is repeated.

After waiting time tw, a new value Z(k+1) for the temperature is detected in step 440. Step 450 then forms the difference ZA between the old value Z(k) and the new value Z(k+1). This difference ZA is a measure of the rise in temperature during waiting time tw.

The subsequent query 460 determines whether the difference ZA is greater than a threshold SA. If this is not the case, the old value Z(k) is overwritten with the new value Z(k+1) in step 470. This is followed by step 420. If query 460 finds that the increase in temperature is greater than an allowed value, step 480 finds that there is an error.

It is further advantageous with the embodiments described here that the device according to the present invention detects either increased or reduced amounts of injected fuel.

An emergency measure that can be provided is for the pressure in the rail to be reduced by means of a pressure limiting valve. Furthermore, the fuel supply to high-pressure pump 145 can be suppressed by closing valve 150.

If the pressure in rail 135 is reduced below the opening pressure of injectors 120 through 123, no fuel flows to injectors that are operating properly. Fuel flows only from one injector with a leaky injector.

To be able to keep the engine running in an emergency mode, the pressure in the rail can be set at a level just above the opening pressure of the nozzles. With this measure, a sensitive engine may nevertheless be damaged because too much fuel can escape from a leaky nozzle.

Reliable emergency operation can be achieved if the engine cylinders are arranged in two groups with a separate high-pressure pump, a separate rail and a separate pressure limiting valve for each group. In this design, only the cylinder group where a combustion chamber has been diagnosed as having an excessively high temperature can be shut down. Emergency operation can be maintained with the second cylinder group.

Yet another alternative is obtained when, instead of or in addition to temperature sensors 181 through 184, at least one pressure sensor is used to supply a signal corresponding to the pressure in the respective combustion chamber. Detection of errors here is performed like in temperature measurement. Pressure signals are processed instead of temperature signals.

What is claimed is:

1. A method for monitoring a fuel delivery system in an internal combustion engine having at least one combustion chamber, comprising the steps of:

providing an output signal from a sensor, the sensor detecting at least one of a temperature and a pressure in at least one of the at least one combustion chamber of the internal combustion engine; and detecting a defect in the fuel delivery system when the output signal deviates from a predetermined threshold value, the predetermined threshold value being stored in a table as a function of at least one of an engine speed and a fuel temperature of the internal combustion engine.

2. The method according to claim 1, wherein the fuel delivery system includes a common rail system of a diesel engine.

3. The method according to claim 1, wherein the output signal corresponds to the temperature in the at least one of the at least one combustion chamber, and wherein the sensor is a temperature sensor.

4. The method according to claim 1, wherein the output signal corresponds to the pressure in the at least one of the at least one combustion chamber, and wherein the sensor is a pressure sensor.

5. The method according to claim 3, wherein the temperature sensor is integrated into a glow plug.

6. The method according to claim 5, wherein the glow plug has a resistance value, the resistance value being analyzed as a function of the temperature.

7. The method according to claim 1, further comprising the step of reducing a pressure in a rail of the internal combustion engine when the defect is detected.

8. The method according to claim 1, wherein the internal combustion engine includes two groups of cylinders, and wherein, when the defect is detected in a defective group of the two groups, the defective group is deactivated.

9. A method for monitoring a fuel delivery system in an internal combustion engine having at least one combustion chamber, comprising the steps of:

providing an output signal from a sensor, the sensor detecting at least one of a temperature and a pressure in at least one of the at least one combustion chamber of the internal combustion engine; and detecting a defect in the fuel delivery system when the output signal is increased by more than a predetermined change value.

10. A device for monitoring a fuel delivery system in an internal combustion engine, comprising:

a sensor for detecting at least one of a temperature and a pressure in at least one combustion chamber of the internal combustion engine and for generating an output signal based thereon; and means for determining a defect in the fuel delivery system, the defect being determined when the output signal from the sensor deviates from a predetermined threshold value, the predetermined threshold value being stored in a table, the predetermined threshold value being a function of at least one of an engine speed and a fuel temperature of the internal combustion engine.

11. The device according to claim 10, wherein the fuel delivery system includes a common rail system of a diesel engine.

12. A device for monitoring a fuel delivery system in an internal combustion engine, comprising:

a sensor for detecting at least one of a temperature and a pressure in at least one combustion chamber of the internal combustion engine and for generating an output signal based thereon; and means for determining a defect in the fuel delivery system, the defect being determined when the output signal from the sensor is increased by more than a predetermined change value.

13. The device according to claim 12, wherein the fuel delivery system includes a common rail system of a diesel engine.

* * * * *